United States Patent [19]

Lundström et al.

[11] Patent Number: 5,017,218

[45] Date of Patent: May 21, 1991

[54] METHOD AND APPARATUS FOR THE PRODUCTION OF METAL GRANULES

[75] Inventors: Per-Åke Lundström; Gunnar A. Andersson, both of Hagfors; Åke West, Rada; Juhan Mägi, Hagfors, all of Sweden

[73] Assignee: Uddholm Tooling Aktiebolag, Hagfors, Sweden

[21] Appl. No.: 365,144

[22] Filed: Jun. 12, 1989

[51] Int. Cl.[5] ..... B01J 2/02

[52] U.S. Cl. ..... 75/388; 264/8; 425/8

[58] Field of Search ..... 75/0.5 C; 264/8; 425/8

[56] References Cited

U.S. PATENT DOCUMENTS

| | | | |
|---|---|---|---|
| 2,304,130 | 12/1942 | Truthe | 75/0.5 C |
| 2,305,172 | 12/1942 | Landgraf | 75/0.5 C |
| 4,323,523 | 4/1982 | Ueda et al. | 264/8 |
| 4,402,884 | 9/1983 | Koike et al. | 75/0.5 C |

FOREIGN PATENT DOCUMENTS 2030181A 4/1979 United Kingdom .

*Primary Examiner*—Olik Chaudhuri
*Assistant Examiner*—Felisa Garrett-Meza
*Attorney, Agent, or Firm*—Armstrong, Nikaido, Marmelstein, Kubovcik & Murray

[57] ABSTRACT

Method and apparatus for the production of metal granules from a molten metal are disclosed. A molten metal stream is directed against an impact element located above the surface of water in a water tank. The impact of the molten metal upon the impact element causes the molten metal to disintegrate into drops which spread out radially from the impact element. The drops fall down into the water below the impact element in an annular region a certain radial distance from the impact element. The radial distance is varied by varying the velocity of the molten metal stream relative to the impact element at the instant of impact, and/or by varying the height of the impact element above the water surface, in order to substantially continuously vary the radius of the annular region in which the molten metal drops hit the water surface.

By using the method and apparatus of the present invention it is possible to granulate metals and metal alloys having a low sinking rate in water and a high enthalpy.

7 Claims, 6 Drawing Sheets

METHOD AND APPARATUS FOR THE PRODUCTION OF METAL GRANULES

TECHNICAL FIELD

This invention relates to the production of metal granules starting from a molten metal which in the form of a stream is caused to fall against an impact element provided above the surface of a volume of water in a water tank, so that the stream of molten metal by impact against the impact element is disintegrated into drops which are spread out in all radial directions from the impact element. The drops fall down into the water provided beneath the impact element in an annular region at a certain radial distance from the impact element, said distance being determined, i.a. by the velocity of the stream of molten metal relative to the impact element at impact against said impact element and by the height of the element above the water surface. The drops of molten metal, as they sink towards the bottom of said tank, successively solidify so that said drops reach the bottom of the tank in the form of granules which are completely solidified or at least solidified on the surface.

BACKGROUND ART

U.S. Pat. No. 3,888,956 describes a method of producing metal granules. The method of this patent is widely used, particularly for the production of crude iron, ferro nickel, ferro chromium, etc. The method has also been used for the granulation of ferro silicon. However, certain problems are involved in the latter application. One of these problems is due to the fact that silicon has a comparatively low density. Moreover, during the solidification, pores are formed in the ferro silicon granules, which further reduce the effect of gravity upon the granules. The granules therefore sink comparatively slowly through the water, with the result that the water at the surface of the water is heated more than in the case when granulating heavier metals and more homogeneous granules, respectively. Further, the heat energy concentration in silicon is very high as compared to many other metals and alloys. The enthalpy per unit of weight of silicon is for example 2.3 times as high as that of iron. A granulation rate of 1000 kg/min of silicon thus, in terms of the amount of heat energy that has been drawn off, corresponds to the granulation of 2300 kg iron/min.

The combination of the low sinking rate and the high enthalpy of silicon and ferro silicon gives rise to very high heat concentrations and the formation of steam in the surface layer of the water when using the described granulation technique. This problem cannot be solved by increasing the intake of cooling water into the water tank, and even heavy circulation of the water will only give a minimal improvement. Therefore, in order to be able to produce granules with desired shapes and sizes, and also to prevent the risk of stream explosions, it is necessary to operate with a granulation rate which in many respects is undesirably low for the granulation of silicon, ferro silicon and the like.

BRIEF DISCLOSURE OF THE INVENTION

It is an object of the present invention to improve the granulation method referred to above, in order to make the method more suitable for the granulation of silicon, ferro silicon and other comparatively low density and/or heavily heat developing metals or metal alloys.

It is also an object of the invention to make it possible to easily increase the granulation capacity of existing plants.

The fact that the improved method of the present invention is adapted to certain requirements particularly relating to the granulation of silicon, ferro silicon and other metals, which have a comparatively low density and which have a high enthalpy content, does not mean that the method is less suitable for the granulation of more "usual" products like iron, ferro nickel, nickel, ferro chromium, steel, etc. To the contrary, it is also an object of the invention to improve the conditions for the granulation of these products as well. Thus any metals (including alloys), which can be granulated with an impact element may be used in the practice of the present invention.

These and other objects can be achieved when the velocity of the molten metal stream relative to the impact element at the instant of impact and/or the height of impact element above the water surface are periodically varied in order to substantially continuously vary the radius of the annular region within which the majority of the drops hit the water surface.

Further features and aspects of the invention will be apparent from the appended claims and from the following description of the preferred embodiment of the method and the apparatus, and from calculations for some conceived cases.

BRIEF DESCRIPTION OF DRAWINGS

In the following description of the preferred embodiment, and of calculations of some conceived cases, reference will be made to the accompanying drawings, in which FIG. 1 schematically illustrates the apparatus according to the present invention.

DESCRIPTION OF PREFERRED EMBODIMENT

Figure 1:
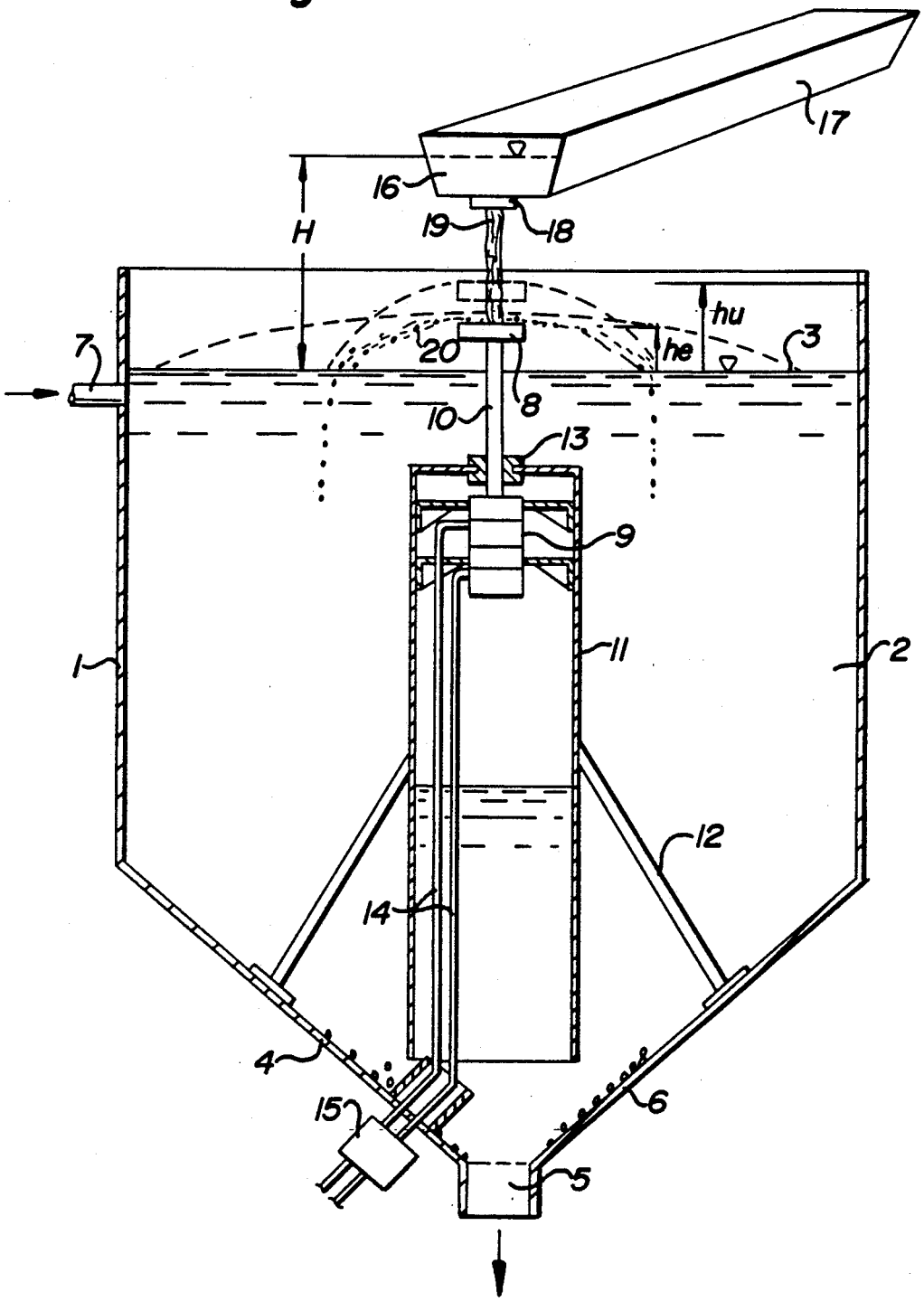
Figure 2:
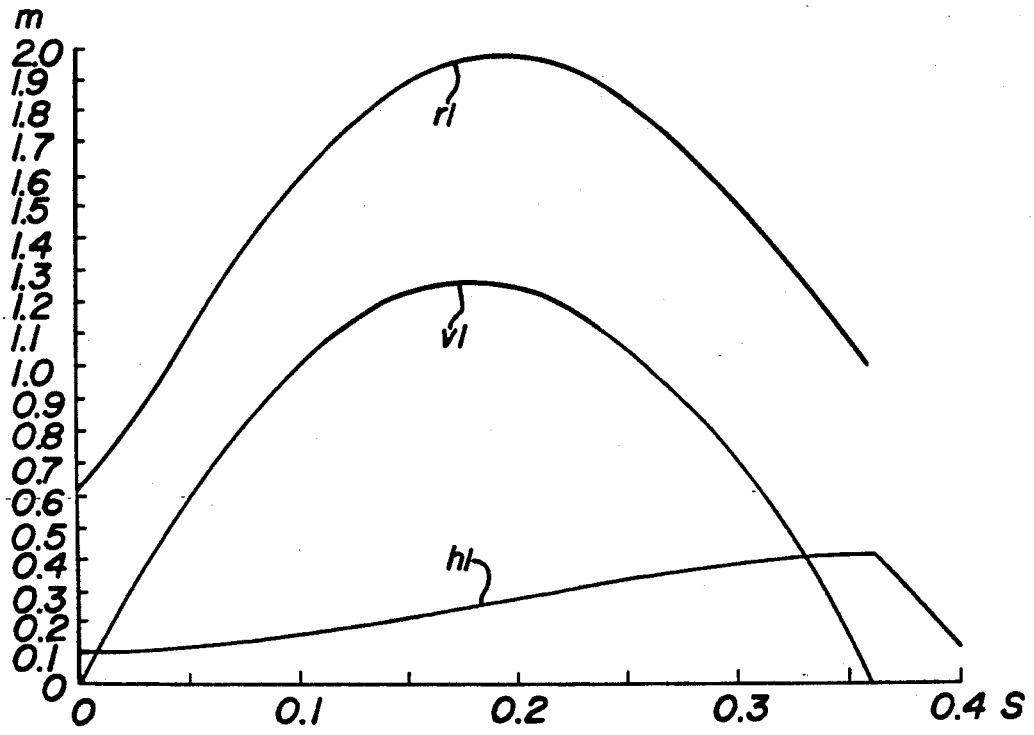
FIGS. 2–6 are diagrams in the form of graphs which show the distribution radius of the molten drops as a function of time during an operation cycle for various parameters, as far as the height of the impact element above the water surface, the total fall, the stroke length, and the period are concerned.
Figure 3:
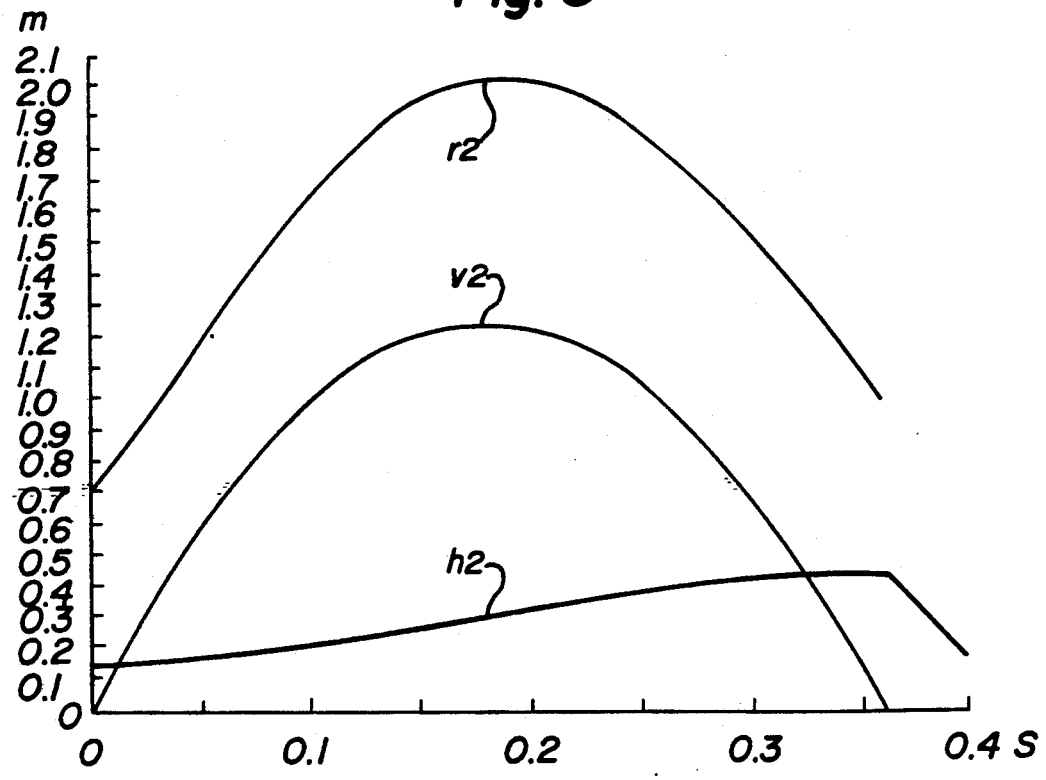
Figure 4:
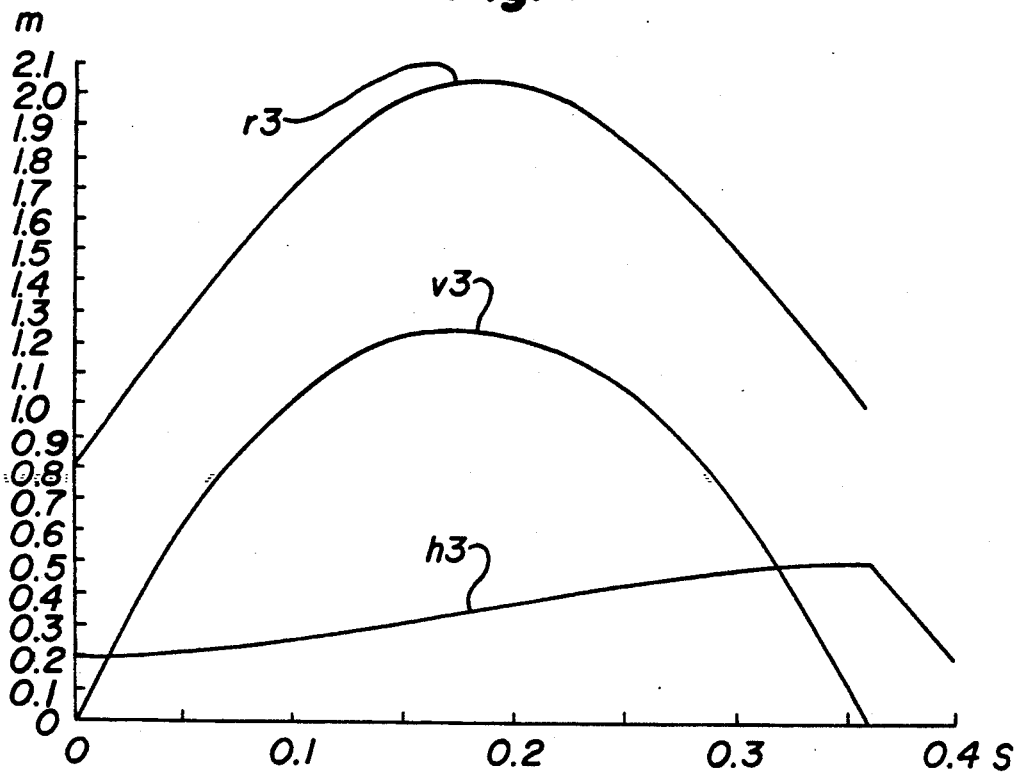
Figure 5:
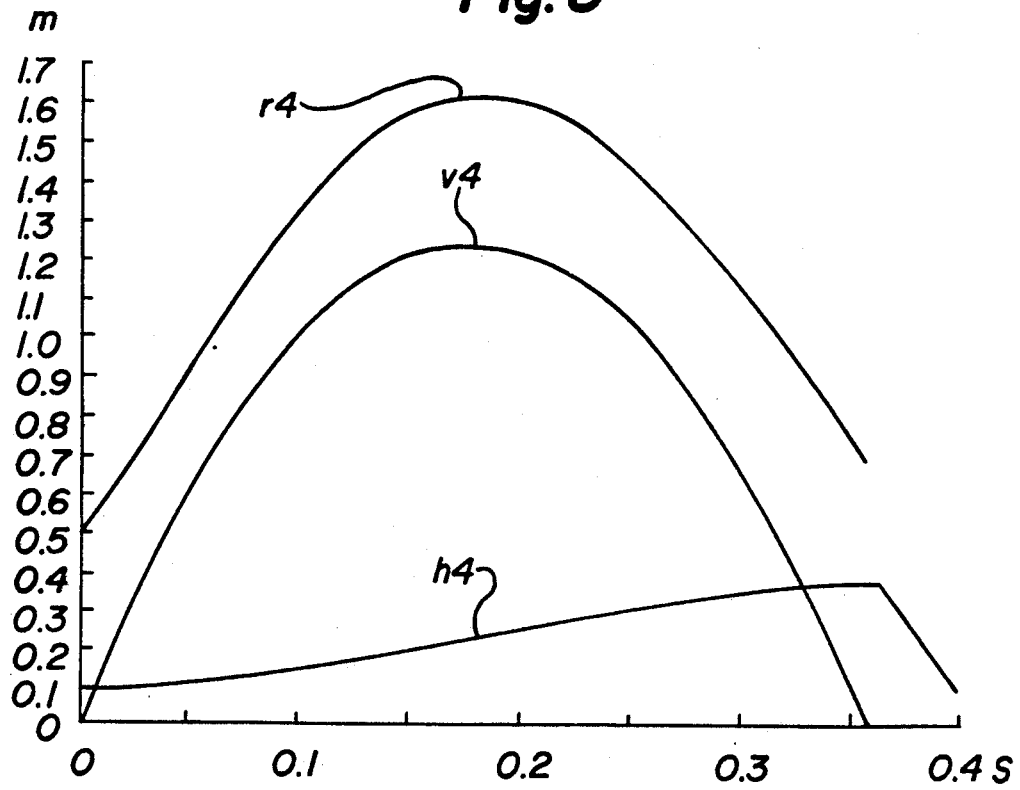
Figure 6:
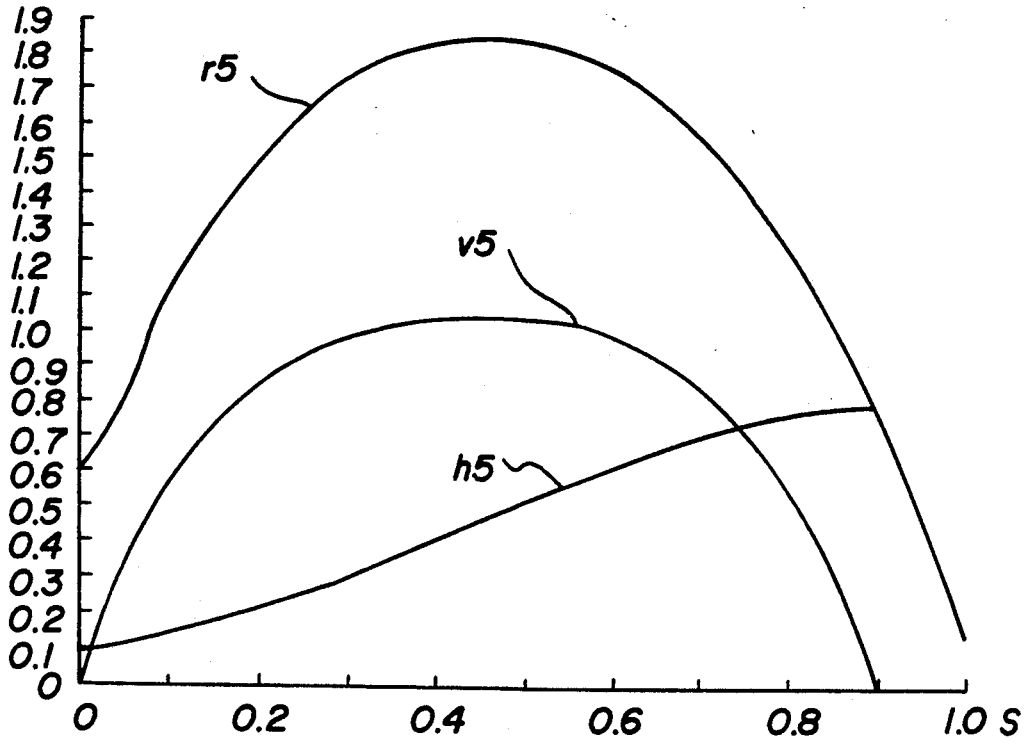
Figure 7:
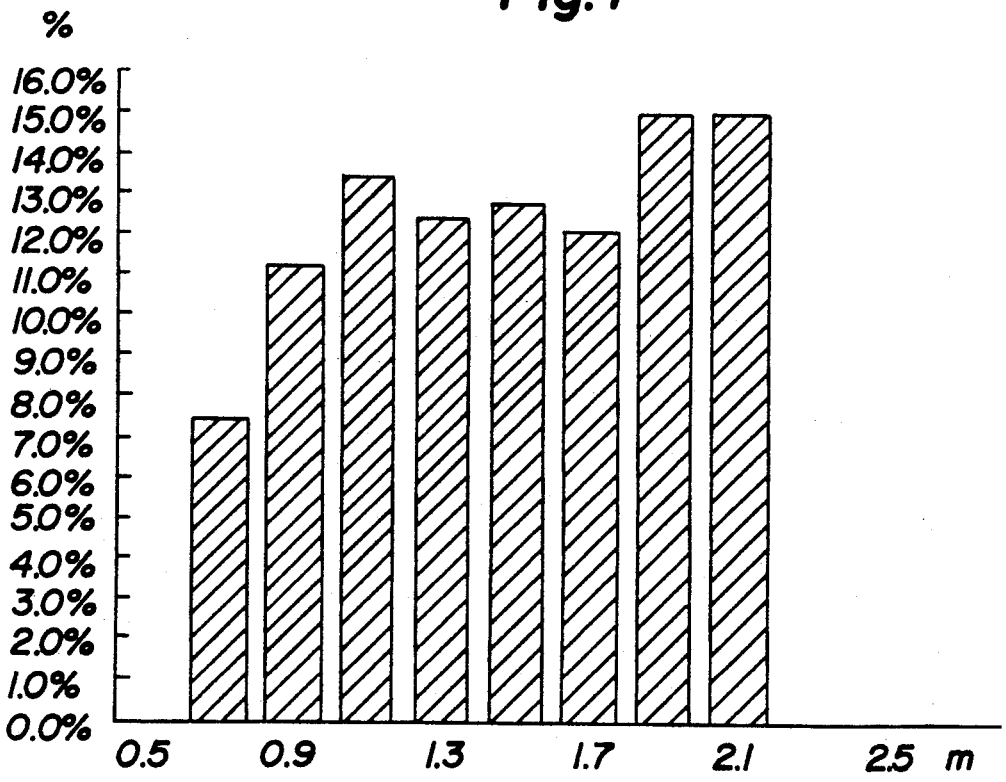
FIGS. 7–11 are bar charts illustrating the distribution of granules in per cent formed at different average distances from the impact element for the different cases which are related to FIGS. 2–6.
Figure 8:
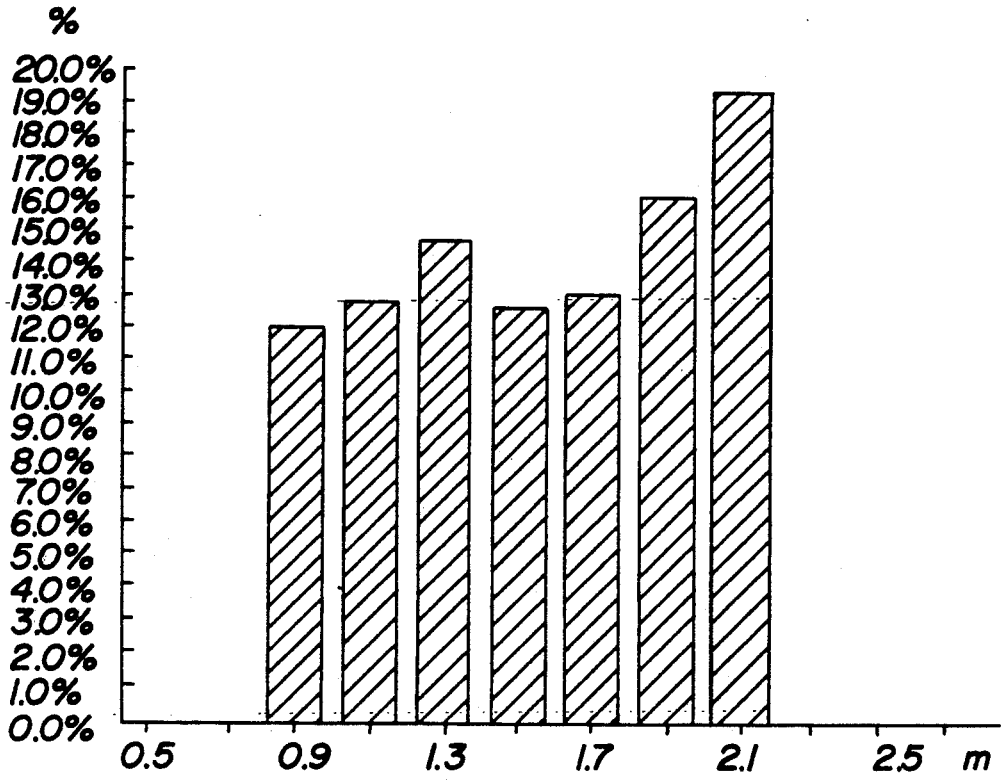
Figure 9:
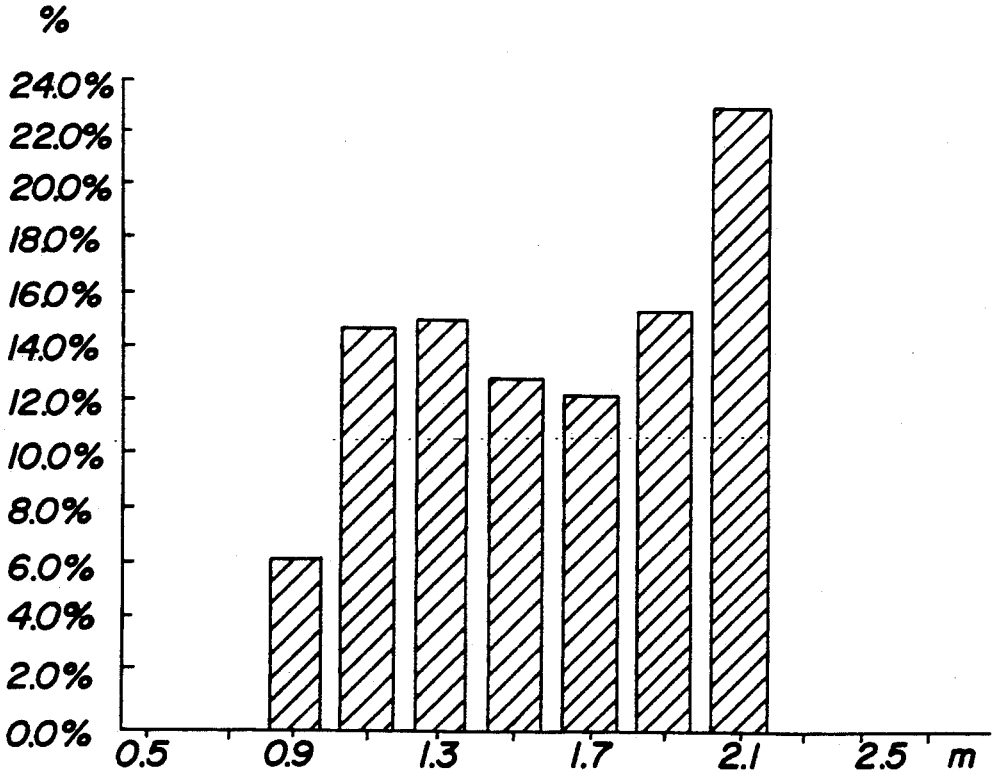
Figure 10:
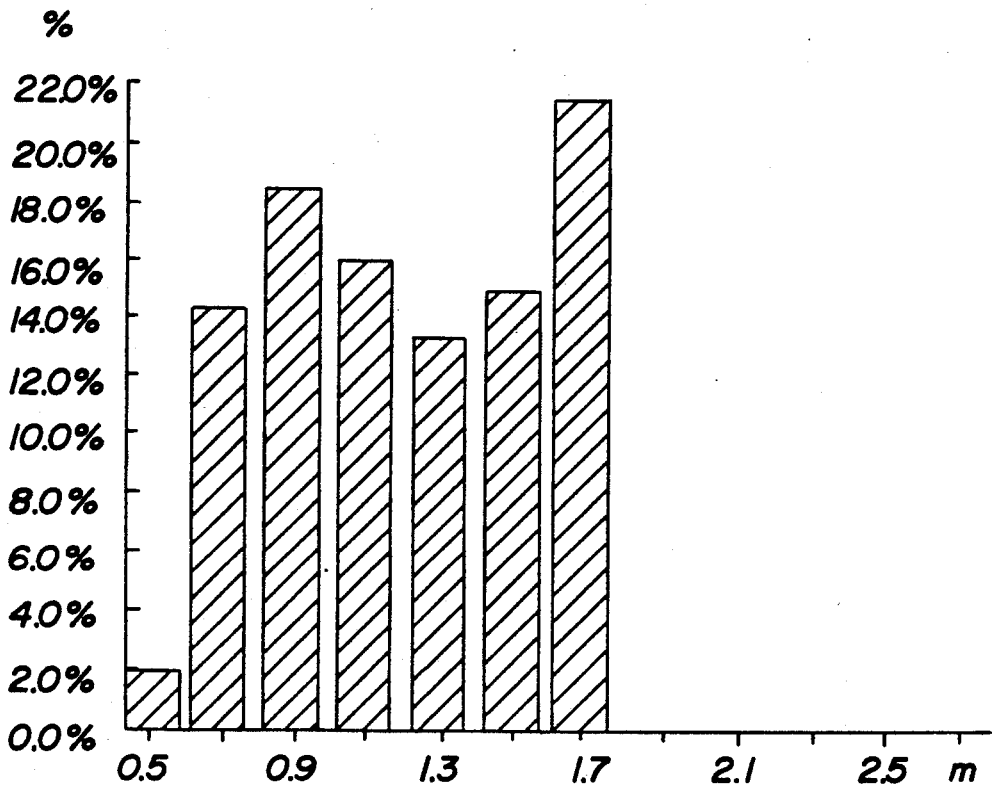
Figure 11:
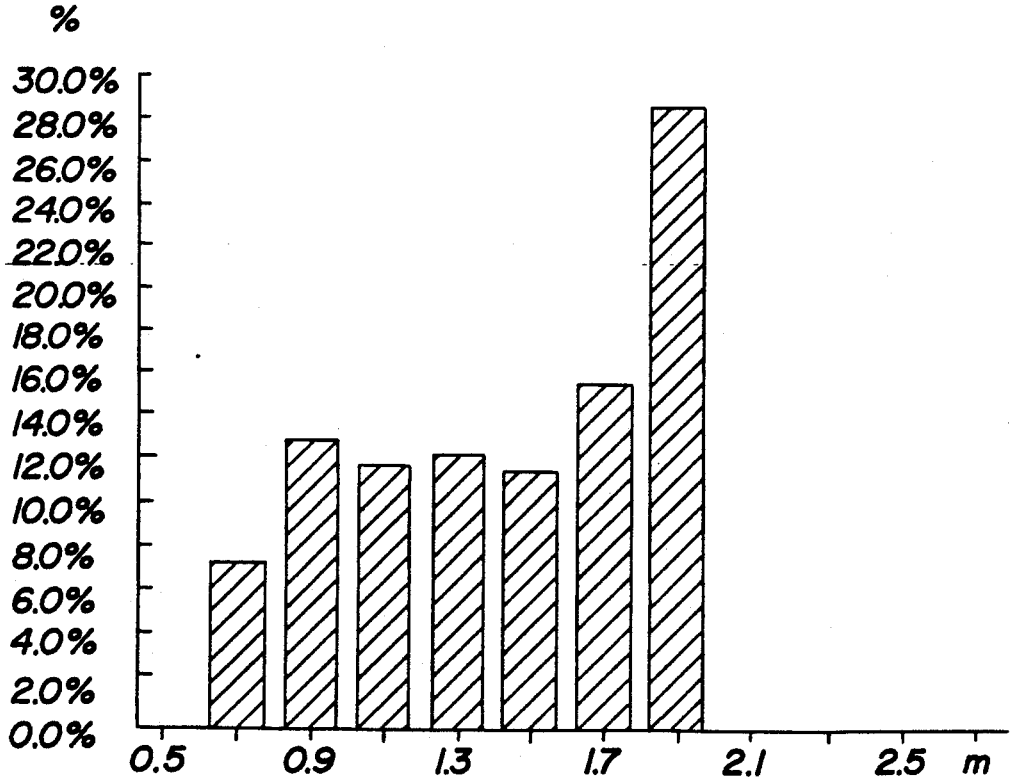

The apparatus which is schematically shown in FIG. 1 comprises a cylindrical tank 1 which is filled with a volume of water 2 to a level 3. The bottom of the tank is conical and converges downward toward a discharge conduit 5 for discharging granules produced together with a certain quantity of water.

Methods known per se can be used to speed up the velocity of the water in the discharge conduit in order to obtain a desired elevation of the granules, e.g. the method described in British Patent No. 2 030 181 or the method described in Swedish Patent No. 7805088-7. Also other methods for lifting the granules can be used, e.g. endless elevators such as described in U.S. Pat. No. 3,888,956. This part of the system will therefore not be described in any detail. A feeding-in conduit for cooling water has been designated 7. Surplus water is supplied through this conduit during the granulation, so that the water level, in combination with a spillway or weir, is maintained at a constant level.

An impact element 8 is located in the centre of the tank at a height h above the water level 3, which height is periodically varied during the granulation between a lower position $h_e$ and an upper position $h_u$ by means of a motion means 9.

The impact element or sprayhead 8 consists in a manner known per se of a round brick of refractory material. The brick has a flat top and is connected with the motion means 9 through a vertical rod 10. The motion means 9, according to the preferred embodiment, consists of a hydraulic cylinder with a piston in the cylinder connected with the rod 10, which in other words defines or is an extension of the piston rod. The hydraulic cylinder 9 is provided in a housing 11 which is supported by supports 12. The housing 11 can be filled with water. A passage for the rod 10 has been designated 13. Conduits 14 for the feeding of hydraulic oil to and from the hydraulic cylinder 9 extend through the housing 11 and through the bottom part 4 of the water tank. Means 15 for the regulation of the flow of oil to and from the hydraulic cylinder 9 are schematically shown.

A tundish 16 with a chute 17 for supplying molten metal to the tundish 16 is provided above the impact element/sprayhead/brick 8. A casting hole 18 is located exactly above the brick 8. The stream of molten metal which hits the brick 8 has been designated 19. The total fall of the molten metal, in other words the level of the molten metal in the tundish 16 above the water level 3, has been designated H.

When the stream of molten metal 19 hits the brick 8, the molten metal is disintegrated into drops 20, which are distributed over the surface of the water in all radial directions along path-ways which more or less have the form of flat parables. If the total fall H and the height h of the brick 8 above the water level 3 is constant, all the drops 20 will hit the water surface 3 within a restricted annular zone at a certain radial distance from the brick 8. When the brick 8 is raised at a comparatively high rate by means of the hydraulic cylinder 9, the falling speed of the stream 19 is added to the vertical velocity of the brick 8, so that the impact energy and hence the distribution radius of the drops 20 will increase. It is realized that certain functional correlations exist between the stroke length S of the brick, its end positions $h_e$ and $h_u$ the total fall H, the velocity of the brick and the period of the motion.

CALCULATIONS

FIGS. 2–11 illustrate five different examples, in which the above mentioned functional correlations have been analyzed theoretically. In Table 1, the numerical values of the lowest height of the sprayhead 8 above the water level, the stroke length, the total fall, the period, and the maximal velocity of the sprayhead in the upward direction have been set forth for the five cases.

TABLE 1

| Example | Figure | $h_e$ cm | S cm | H cm | P sec | V max cm/sec |
|---|---|---|---|---|---|---|
| 1 | 2 and 7 | 10 | 30 | 100 | 0.4 | 125 |
| 2 | 3 and 8 | 15 | 30 | 100 | 0.4 | 125 |
| 3 | 4 and 9 | 20 | 30 | 100 | 0.4 | 125 |
| 4 | 5 and 10 | 10 | 30 | 70 | 0.4 | 125 |

TABLE 1-continued

| Example | Figure | $h_e$ cm | S cm | H cm | P sec | V max cm/sec |
|---|---|---|---|---|---|---|
| 5 | 6 and 11 | 10 | 70 | 100 | 1.0 | 105 |

$h_e$: The lowest height of the sprayhead above the water level
S: The stroke length of sprayhead
H: The total fall of the molten metal
P: The period
V max: The maximal speed of the upward directed motion of the sprayhead The graph illustrating the rate of the sprayhead was identical in examples 1–4. Starting from the speed 0 at the beginning of each period, the upward directed movement of the sprayhead 8 was first accelerated, so that the speed reached a maximum of 125 cm/sec after a time period of 0.18 second. Thereafter the motion was retarded to 0 when the sprayhead 8 reached its upper position, when the height $h_u$ above the water level 3 was 40, 45, 50, and 40 cm, respectively, which occurred after 0.36 sec. At the instant when the sprayhead had its highest upward directed speed V max, it just passed the first half of its stroke length, which means that the height h in the first four examples in this instant was 25, 30, 35, and 25 cm, respectively. When the sprayhead 8 had reached its highest point—the height $h_u$ above the water level 3—the sprayhead was rapidly brought back to its starting position with the height $h_e = 10$ cm above the water level 3 during the 0.04 second which remain of the period.

The height h of the sprayhead above the water level 3 expressed in meters, its upward directed speed v expressed in meters/sec and the distribution r of the granules expressed in meters (mean value of the radial distance where the drops hit the water surface) as a function of time during a cycle are illustrated in FIGS. 2–6 in the form of the graphs h1, h2 . . . h5; v1, v2 . . . v5; and r1, r2 . . . r5 in the five examples, respectively.

In all the examples, the largest distribution, r max, was achieved immediately after the instant when the sprayhead 8 had passed half of its total stroke length. The smallest distribution in all the examples was achieved in the starting position, when the sprayhead 8 was located in its lowest position $h_e$ above the water level.

It is desirable that the drops 20 be distributed substantially evenly over the water surface during each cycle of operation, which means that a larger amount of drops should land in the outmost annular region, since the drops in that region can be distributed over a larger surface than for annular regions which are closer to the centre. Moreover, the cooling is more efficient in the outer parts, because of the proximity of the entrance of cooling water through conduit 7, which also is favourable for a more dense distribution of drops of molten metal in the outer regions. The best chart of distribution, FIG. 7, was achieved in example 1. In examples 2 and 3 the central parts of the tank were not efficiently utilized for the granulation. In example 4, when the total fall was lower than in the other examples, the peripheral or outer parts of the tank were not used, which is not good, since there is excess capacity for a large tank. On the other hand, such a distribution may be desirable in those cases when there is available only a relatively small tank. This to some extent also concerns example 5, where, however, the general character of the distribution chart, FIG. 11, approaches closer to the ideal.

We claim:

1. A method for the production of metal granules from molten metal comprising the steps of:

(a) forming the molten metal into a falling stream; and (b) impacting the falling stream of molten metal against an impact element located above the surface of a water-containing tank, whereby the stream of molten metal is disintegrated, by the impact against the impact element, into drops which (1) spread out in substantially all radial directions from the impact element;

(2) fall down into the water in an annular region at a given radial distance from the impact element, wherein the radial distance is determined by (i) the velocity of the stream of molten metal compared to the velocity of the impact element at the instant of impact, and (ii) the height of the impact element above the water surface;

and wherein said radial distance is periodically varied during the disintegration of the molten metal by periodically varying the height of said impact element above said water surface by periodically moving said impact element in a vertical direction by an upward stroke from a lower position to an upper position and from said upper position in a downward stroke back to said lower position, said disintegration taking place substantially only during said upward stroke;

(3) sink towards the bottom of the tank; and (4) solidify so that when the drops reach the bottom of the tank they are solidified at least on a surface thereof.

2. The method of claim 1, wherein the lowest position of the impact element is between 5 and 50 cm above the surface of the water, and the impact element is oscillated vertically a distance of 10 to 100 cm.

3. The method of claim 2, wherein the total height of the fall of the stream of molten metal is maintained constant between 40 and 200 cm.

4. The method of claim 2, wherein the velocity of the stream of molten metal relative to the impact element at the instant of impact is varied by raising and lowering the impact element at a frequency of 30 to 300 cycles per minute.

5. The method of claim 1, wherein the impact element during its upward directed motion of each cycle, starting from the lowest position, first is accelerated until it reaches a certain maximal speed, and thereafter it is further advanced at a retarding speed until it reaches its upper position, whereafter it very quickly is brought back to its lowest or starting position.

6. The method of claim 5, wherein the velocity of the impact element when it is brought back to its starting position is faster than the velocity of the falling stream of molten metal.

7. The method of claim 1, wherein the metal is silicon or ferro silicon.

* * * * *